US009938774B2

(12) United States Patent
Lyon

(10) Patent No.: US 9,938,774 B2
(45) Date of Patent: Apr. 10, 2018

(54) NON-ROTATING DRILL BIT FOR A DOWN-THE-HOLE DRILL HAMMER

(71) Applicant: Center Rock Inc., Berlin, PA (US)

(72) Inventor: Leland H. Lyon, Roanoke, VA (US)

(73) Assignee: CENTER ROCK INC., Berlin, PA (US)

( * ) Notice: Subject to any disclaimer, the term of this patent is extended or adjusted under 35 U.S.C. 154(b) by 658 days.

(21) Appl. No.: 14/068,121

(22) Filed: Oct. 31, 2013

(65) Prior Publication Data

US 2014/0131116 A1 May 15, 2014

Related U.S. Application Data

(60) Provisional application No. 61/724,609, filed on Nov. 9, 2012.

(51) Int. Cl.
*E21B 10/36* (2006.01)
*E21B 10/38* (2006.01)
*E21B 10/46* (2006.01)

(52) U.S. Cl.
CPC ..... *E21B 10/36* (2013.01); *E21B 10/38* (2013.01); *E21B 10/46* (2013.01)

(58) Field of Classification Search
CPC ..... E21B 10/36; E21B 10/46; E21B 10/38
See application file for complete search history.

(56) References Cited

U.S. PATENT DOCUMENTS 2,262,001 A * 11/1941 Hokanson ..... E21B 10/40 175/390
2,381,415 A * 8/1945 Williams, Jr. ..... E21B 10/46 175/400
2,786,373 A * 3/1957 Patton ..... B23B 51/009 408/223
2,830,795 A * 4/1958 Center, Jr. ..... E21B 10/006 125/20
4,116,289 A * 9/1978 Feenstra ..... E21B 10/26 175/391
4,324,300 A * 4/1982 Logan, Jr. ..... E21B 10/006 175/379
2004/0076483 A1* 4/2004 Singh ..... B23B 51/009 408/1 R
2009/0184564 A1* 7/2009 Brady ..... E21B 10/36 299/100
2009/0321143 A1 12/2009 Lyon
2010/0252330 A1* 10/2010 Gilbert ..... E21B 4/06 175/293
2011/0240373 A1 10/2011 Lyon et al.

* cited by examiner

*Primary Examiner* — David J Bagnell
*Assistant Examiner* — Michael A Goodwin
(74) *Attorney, Agent, or Firm* — Kim Winston LLP

(57) ABSTRACT

A non-rotational drill bit for a down-the-hole drill hammer is provided that includes a head and a shank extending from the head. The head includes a plurality of axisymmetric cutting members about its working face. The drill bit also includes a porting system that includes a central through hole, an air inlet port, an exhaust outlet port and a central exhaust port for exhausting air from an interior of the drill hammer and for clearing drilling debris from the face of the drill bit.

16 Claims, 28 Drawing Sheets

NON-ROTATING DRILL BIT FOR A DOWN-THE-HOLE DRILL HAMMER

CROSS REFERENCE TO RELATED APPLICATIONS

The present application claims the benefit of priority pursuant to 35 U.S.C. § 119(e) of U.S. Provisional Patent Application No. 61/724,609, filed Nov. 9, 2012, the entire disclosure of which is hereby incorporated by reference herein.

BACKGROUND OF THE INVENTION

The present invention relates generally to down-the-hole drill (DHD) hammers. In particular, the present invention relates to a non-rotating drill bit for a down-the-hole drill hammer.

Typical DHDs include a hammer having a piston that is moved cyclically with high pressure gas (e.g., air). The piston generally has two end surfaces that are exposed to working air volumes (i.e., a return volume and a drive volume) that are filled and exhausted with each cycle of the piston. The return volume pushes the piston away from its impact point on a bit end of the hammer. The drive volume accelerates the piston toward its impact location on the back end of the drill bit. The overall result is a percussive drilling action.

Conventional drill bits 100, as shown in FIGS. 1 and 1A, used in DHD applications are typically constructed to include cutting inserts 102 that are positioned at a bottom end face of the drill bit. The cutting inserts 102 serve to cut rock or other material upon impact. However, due to the structure and spacing of the inserts 102, the drill bit must be rotated or indexed a certain amount after each cycle of the piston to reposition the cutting inserts upon a different region of a bore hole.

The need to rotate the drill bit in conventional DHD hammers imparts complexity in design of the DHD hammer as it necessitates a mechanism to rotate the drill bit. Increased complexity in DHD hammers consequently increases the likelihood that such hammers will fail during operational use, which occurs in very harsh environments over prolonged periods of time.

As such, a need exists for a DHD hammer than can address the foregoing needs of conventional DHD hammers. Such needs are satisfied by the DHD hammer of the present invention.

BRIEF SUMMARY OF THE INVENTION

In accordance with the present invention, the problems associated with the increased complexity of rotational drive mechanisms necessary for conventional DHD hammers are solved by engendering a drill bit for a DHD hammer that does not need to be rotated or indexed in order to effectively drill into earthen terrain. With such a non-rotating drill bit, a DHD hammer can be constructed with less complexity and more durability which will effectively improve the overall performance of the DHD hammer's drilling operation.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

Figure 1A:
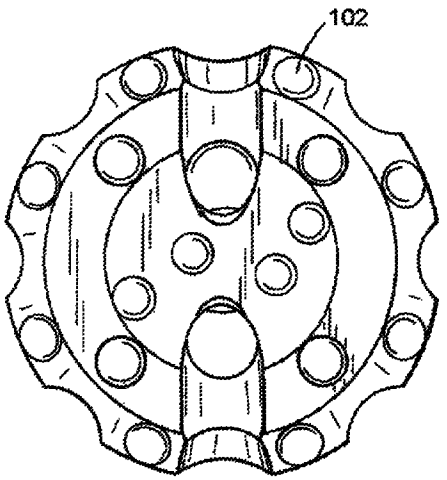
FIG.1A PRIOR ART
FIG. 1A is a bottom plan view of the conventional down-the-hole drill hammer drill bit of FIG. 1.
Figure 1:
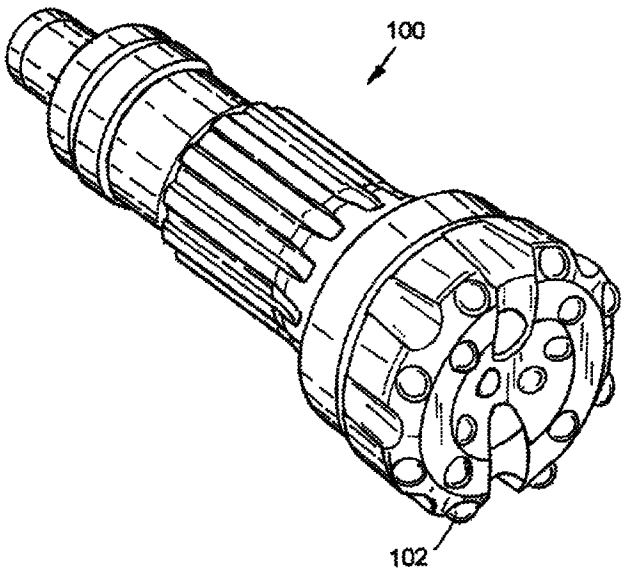
FIG.1 PRIOR ART
FIG. 1 is a perspective view of a conventional down-the-hole drill hammer drill bit.
Figure 2:
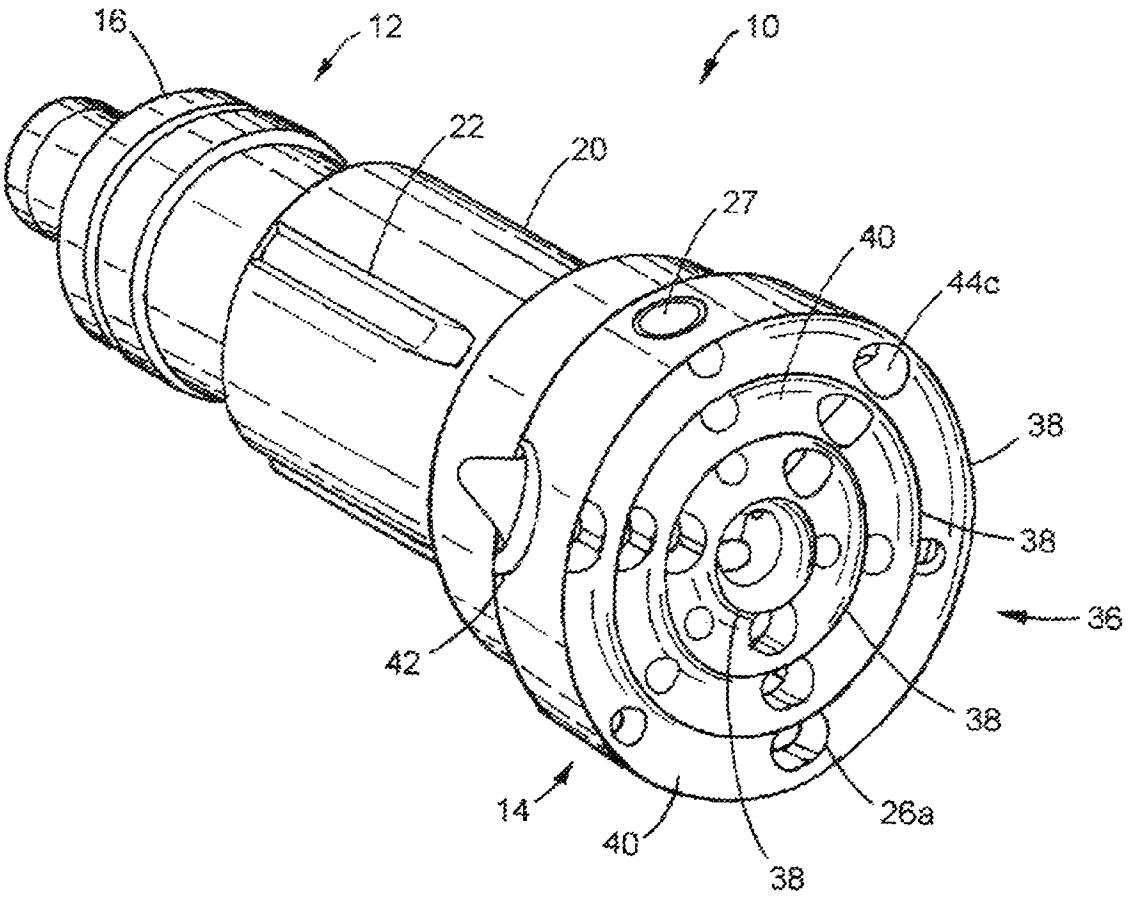
FIG. 2 is a perspective view of a drill bit for a down-the-hole drill hammer in accordance with a preferred embodiment of the present invention.
Figure 3:
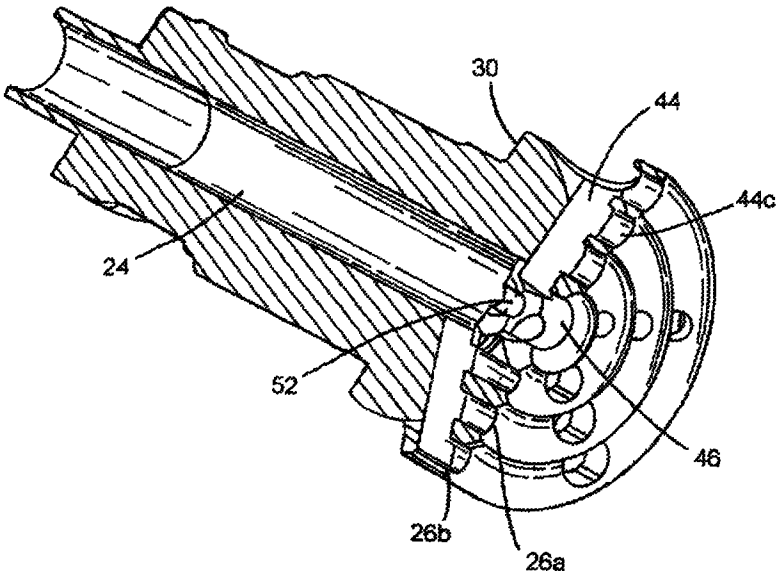
FIG. 3 is a cross-sectional perspective view of the drill bit of FIG. 2.
Figure 4:
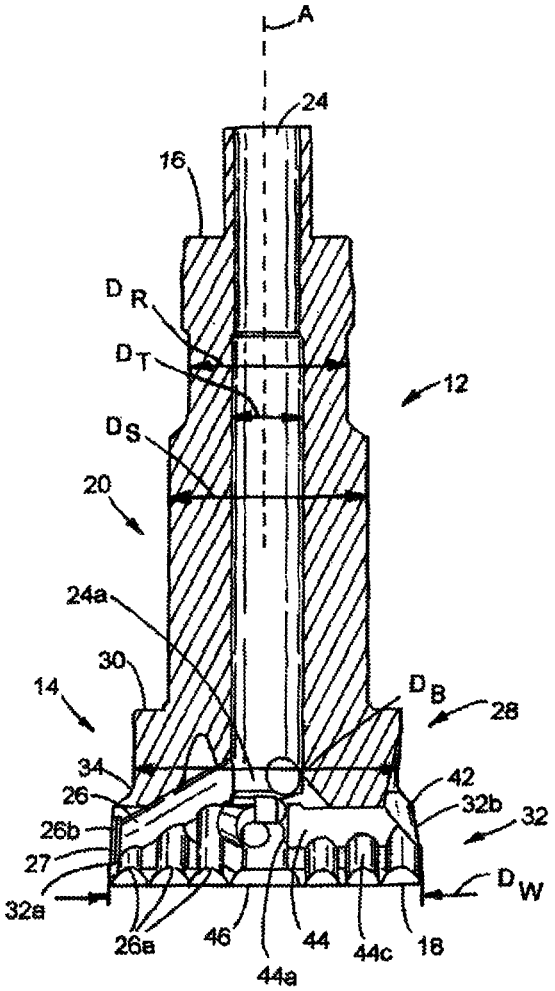
FIG. 4 is a side cross-sectional elevation view of the drill bit of FIG. 2.

Referring to FIGS. 2-12, in a preferred embodiment, the present invention provides for a DHD hammer having a drill bit 10. The drill bit 10 is configured as best shown in FIGS. 2 and 4, and includes a shank 12 and a head 14. The shank 12 extends distally from the head 14 an axial length about two to three times the axial length of the head 14.

In operation, the drill bit 10 is assembled to a DHD hammer (not shown) having a housing, a piston that percussively moves within the housing, and a backhead about a top end of the DHD hammer for connection to a drill string. The drill bit 10 is assembled to the DHD hammer about a bottom end of the DHD hammer. Such assembly of a drill bit to the DHD hammer and the overall general operation of the DHD hammer (excluding the drill bit 10) is know in the art and a detailed description of such structure and operations is not necessary for complete understanding of the present invention. However, exemplary DHD hammers applicable to the present invention are described in U.S. Patent Application Publication Nos. 2009/0321143 and 2011/0240373, the entire disclosures of which are incorporated herein by reference in their entirety.

The shank 12 is configured as best shown in FIGS. 2-4 and includes an impact surface 16 upon which a piston (not shown) cyclically impacts. The impact surface 16 faces upwardly (as shown in FIG. 4) and in a direction opposite a distal face 18 of the drill bit 10. About a bottom portion of the shank 12 is a larger diameter section 20 i.e., a section having a diameter larger than the diameter of the shank 12 forming the impact surface 16. The larger diameter section 20 includes one or more axially extending grooves 22, and preferably four axially extending grooves 22 equidistantly and circumferentially spaced apart. The larger diameter section 20 is positioned distal to the impact surface 16. In between the impact surface 16 and the larger diameter section 20 is a reduced diameter section $D_R$. The reduced diameter section is smaller in diameter compared to the diameter of the shank 12 forming the impact surface 16 and the larger diameter section 20.

A central through hole 24 extends through the shank 12 from a top end of the drill bit 10 to the head 14 and is coaxial with a central longitudinal axis A of the shank 12. The central through hole 24 is sized to have a diameter $D_T$ about ¼ to ¾ of the overall diameter $D_S$ of the shank 12 and more preferably about ½ the diameter of the overall diameter of the shank 12. The central through hole 24 is in communication with one or more air inlet ports 26 of the head 14, as further discussed below, and functions to serve as a porting system to exhaust air from within the DHD hammer interior to an exterior of the DHD hammer via the air inlet ports 26.

The head 14 of the drill bit 10 includes a body portion 28 from which the shank 12 extends thereform and is adjacent the larger diameter section. The body portion 28 is configured to have a cylindrical shape with a diameter $D_B$ that is greater than the overall diameter $D_S$ of the shank 12. Further, the body portion 28 is connected to the shank 12 so as to be coaxial with the shank 12. Additionally, as the body portion 28 extends further radially outwardly than the shank 12, a stepped or flange extension 30 exists and faces upwardly (as shown in FIG. 4) in the same direction as the impact surface 16.

Referring to FIG. 4, extending downwardly and tapering outwardly from the body portion 28 is a working portion 32 of the head 14. The overall diameter $D_W$ of the working portion 32 is larger than that of the overall diameter $D_B$ of the body portion 28. The external region of the head 14 connecting or transitioning from the body portion 28 to the working portion 32 is rounded so as to form a fillet 34. The overall profile of the working portion 32 is substantially frustum shaped with the sides of the working portion 32 tapering outwardly in a direction traveling towards the distal face 18.

Referring back to FIG. 2, the working portion 32 includes a working face 36 that faces in a direction opposite the impact surface 16 and is intended to impact a drilling target e.g., earthen terrain. The working face 36 includes a plurality of cutting members 38. The cutting members 38 are axisymmetric to the central longitudinal axis A of the drill bit 10 i.e., the cutting members 38 are axisymmetric cutting members. Owing to the axisymmetric configuration of the cutting members 38, the drill bit 10 does not need to be rotated or indexed upon cycling of the piston within the DHD hammer. As such, the drill bit 10 functions as a non-rotating DHD hammer dill bit for a DHD hammer.

Specifically, the cutting members 38 are configured as circular cutting rings 38. The circular cutting rings 38 are equidistantly spaced apart from each other in a radial direction and extend downwardly from the working portion 32. Alternatively, the circular cutting rings 38 can be asymmetrically spaced apart. The tips of the circular cutting rings 38 are configured as wedges or dual inclined planes. More particularly, the tips of the circular cutting rings 38 have a width from about 1/32 to ⅛ inch and preferably a width of about 1/16 of an inch. However, the widths of the circular cutting rings 38 can be greater than ⅛ inch, such as ¼ or ½ inch, and less than 1/32 inch, such as 1/48 or 1/64 inch.

The cutting members 38 are formed from metal, such as but not limited to steel. The cutting members 38 are also preferably coated or treated with a plasma sprayed hardfacing, a flame sprayed hardfacing, or tungsten carbide cloth, such as Kennametal Conforma Clad.

Between a pair of circular cutting rings 38 is an inner race 40 that extends upwardly from the tips of the circular cutting rings 38. The inner race 40 is substantially a concave shaped inner race.

The inner race 40 functions to provide a cavity or space within which drilling debris can flow upon operation of the DHD hammer. Further, the inner race 40 functions as an air flow raceway directing the flow of exhaust air within the inner race 40 along with drilling debris to one or more exhaust ports 42, as further described below.

Preferably, the working face 36 of the drill bit 10 includes at least two, preferably three, and more preferably four circular cutting rings 38 equidistantly spaced apart in the radial direction. However, the working face 36 can be configured with more than four circular cutting rings 38, such as five, six, seven or eight circular cutting rings 38.

Figure 5:
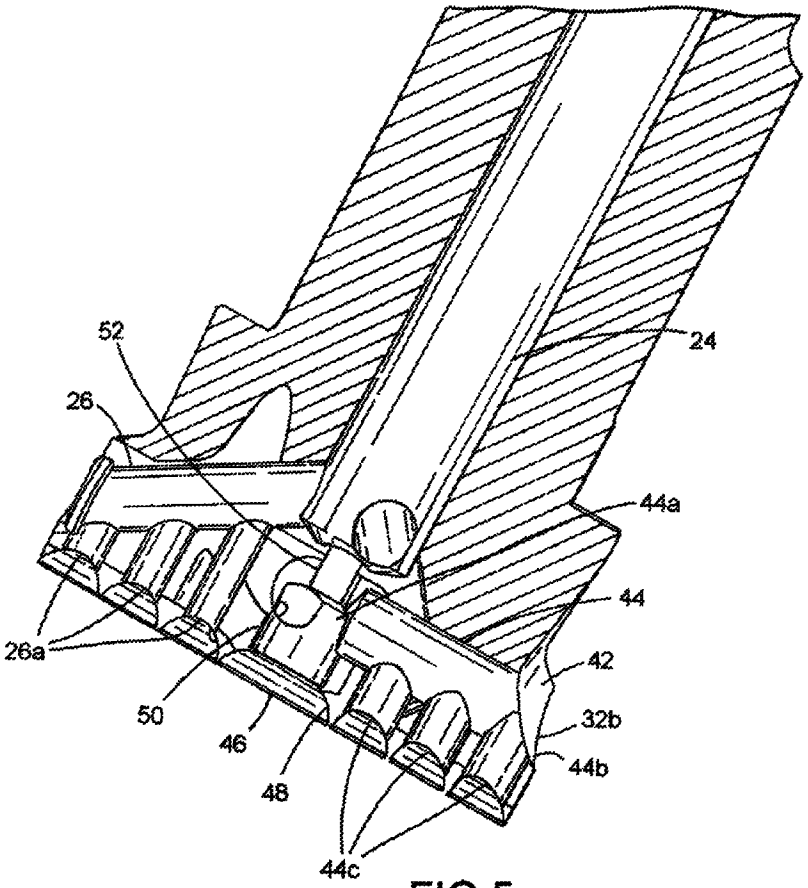
FIG. 5 is an enlarged partial cross-sectional perspective view of the drill bit of FIG. 2.
Figure 6:
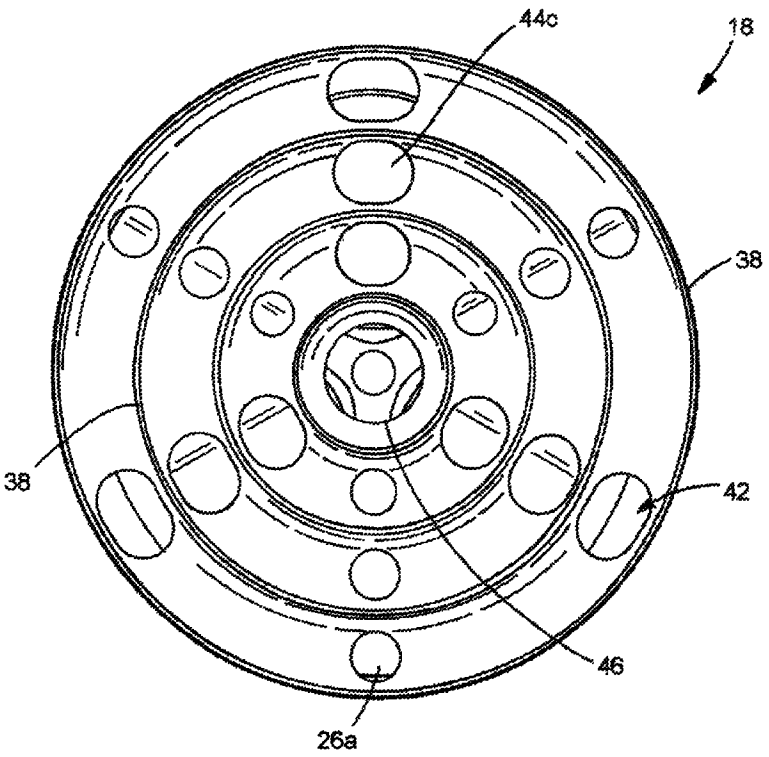
FIG. 6 is a bottom plan view of the drill bit of FIG. 2.
Figure 7:
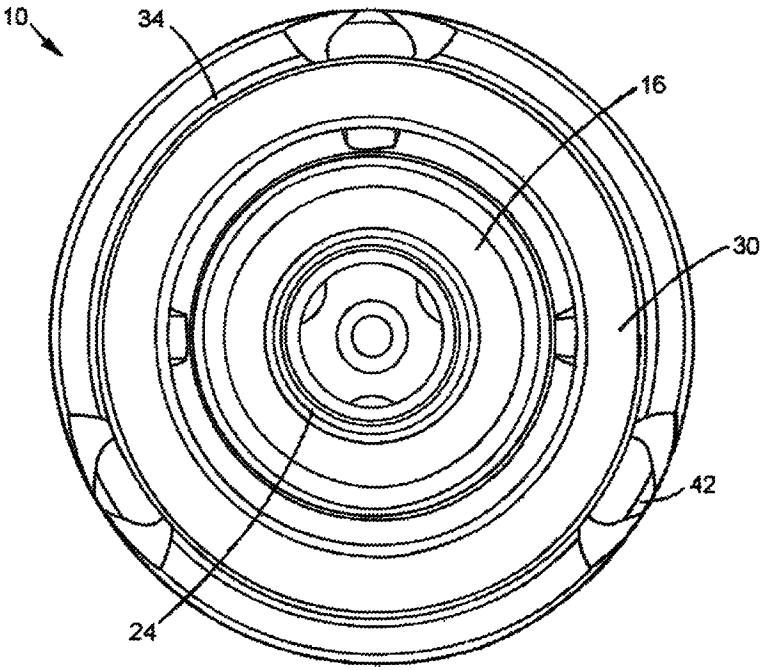
FIG. 7 is a top plan view of the drill bit of FIG. 2.
Figure 8:
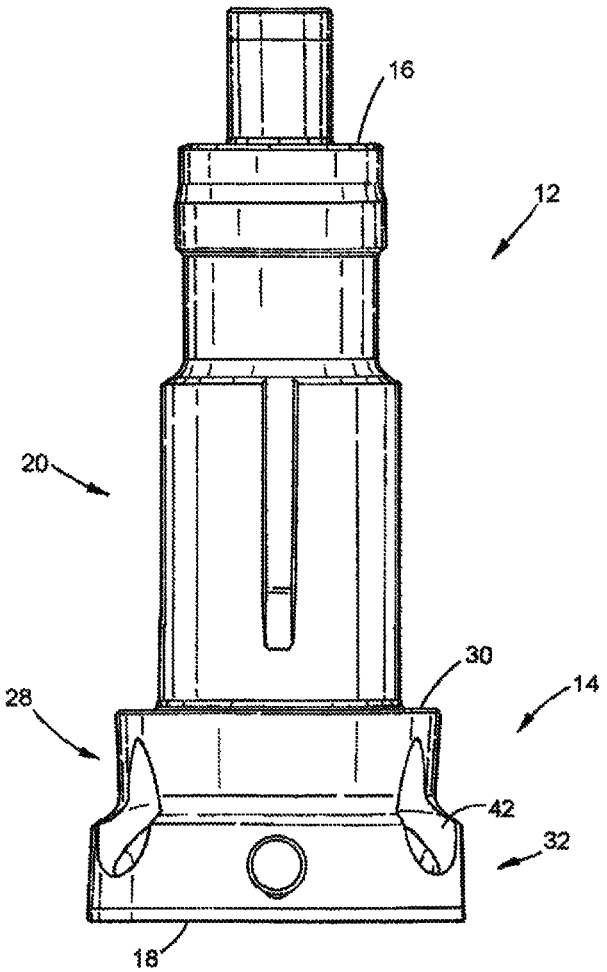
FIG. 8 is a first side elevation view of the drill bit of FIG. 2.
Figure 9:
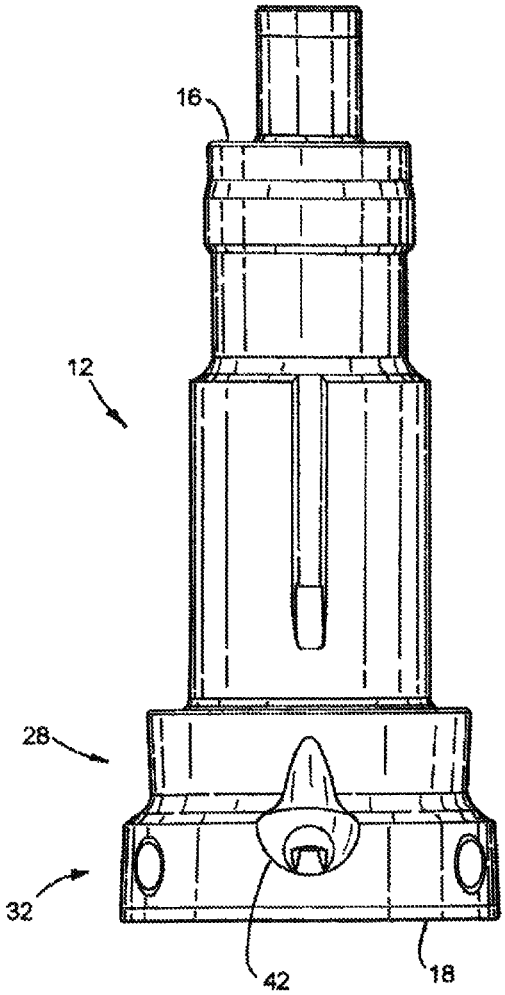
FIG. 9 is a second side elevation view of the drill bit of FIG. 2.
Figure 10:
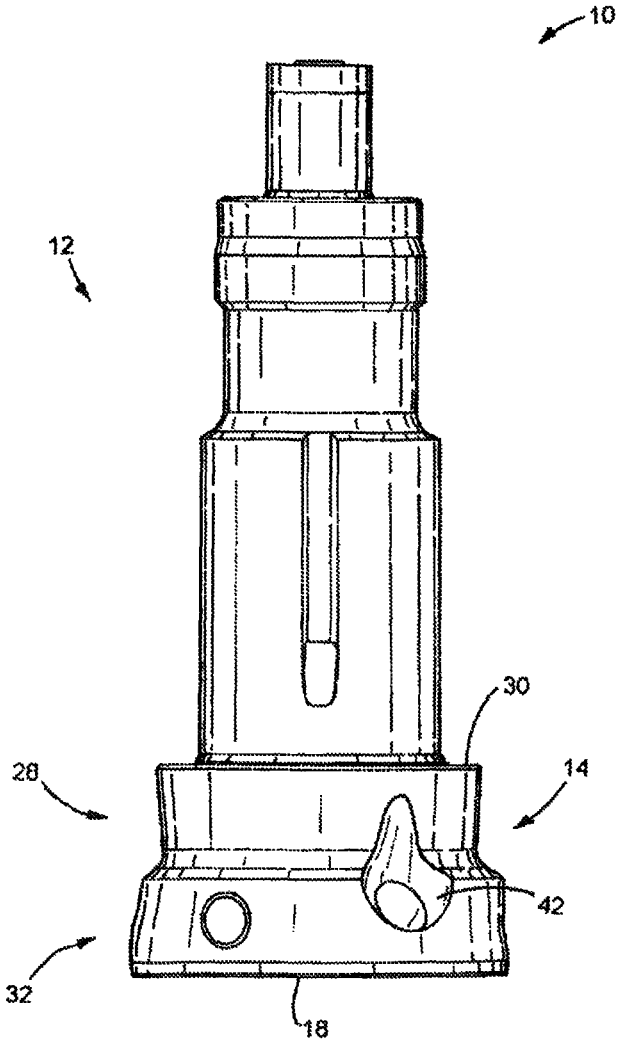
FIG. 10 is a third side elevation view of the drill bit of FIG. 2.
Figure 11:
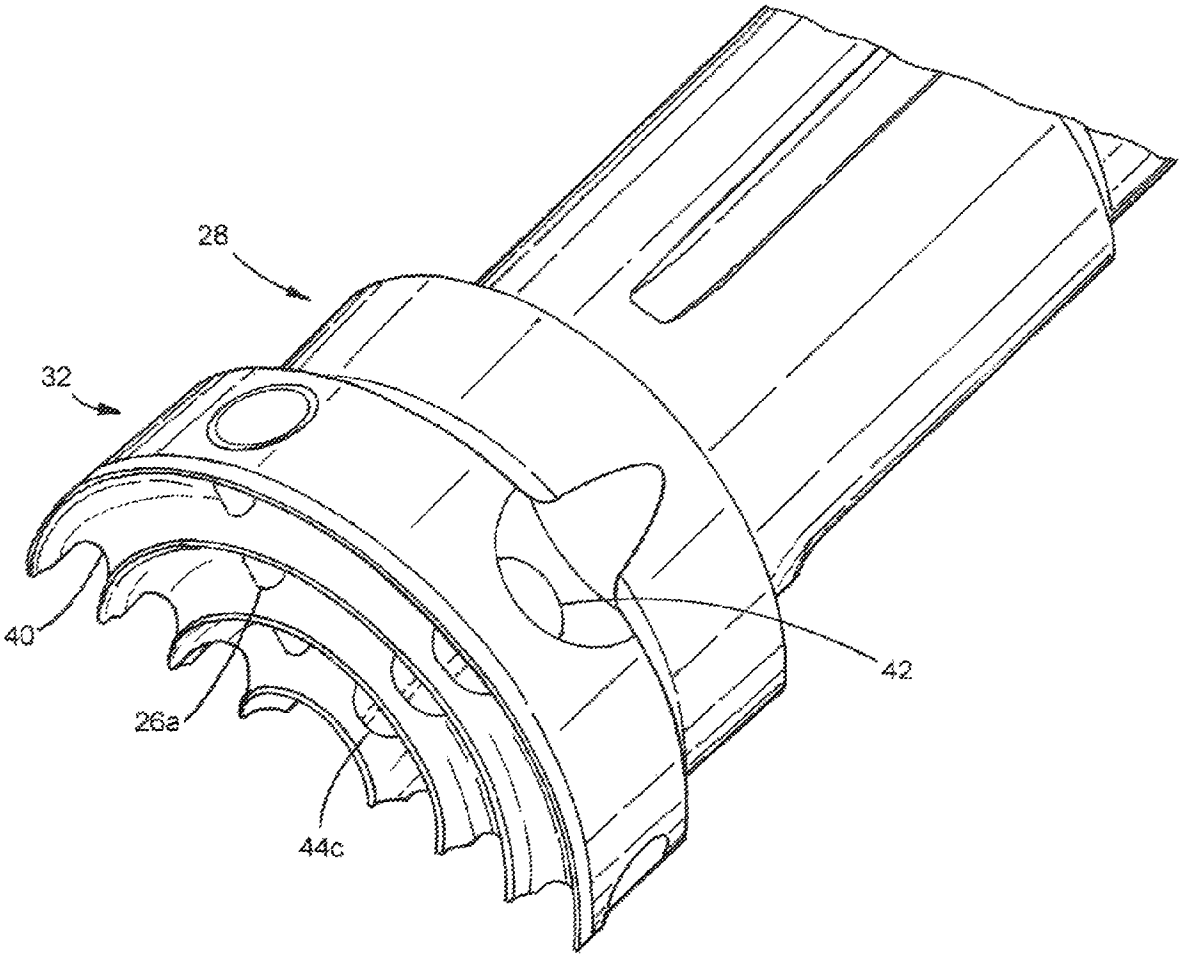
FIG. 11 is a enlarged partial perspective view of a section of the drill bit of FIG. 2.

Referring to FIGS. 4 and 5, the central through hole 24 terminates substantially within the body portion 28 of the head 14. One or more air inlet ports 26 extends from a bottom portion of the central through hole 24*a* to an outer section 32*a* of the working portion 32. The air inlet ports 26 are in fluid communication with the central through hole 24. Preferably, each of the air inlet ports 26 are angled downwardly and outwardly as they extend from the bottom portion of the central through hole 24*a*. Each of the air inlet ports 26 includes port extensions 26*a* that are each in communication with a respective inner race 40. The number of port extensions 26*a* extending from an air inlet port 26 is determined by the number of inner races 40 formed on the distal face of the drill bit 10.

The air inlet port 26 is initially formed as a port that extends completely from the central through hole 24 to an exterior of the working portion 32 for purposes of manufacturing. However, the external end 26*b* of the air inlet port 26 is sealed with an end cap 27 and preferably hermetically sealed with the end cap 27. As a result, exhaust air passing through the air inlet ports 26 is forced through the port extensions 26 and out to the inner races 40.

The working portion 32 of the drill bit 10 also includes an exhaust outlet port 44. The exhaust outlet port 44 extends horizontally in a radial direction from about a middle section of the working portion 32 to an outer section 32*b* of the working portion 32. The exhaust outlet port 44 has an inner end 44*a* closest to the central longitudinal axis A of the drill bit 10 that is in fluid communication with a central exhaust port 46, as further discussed below. The end opposite the inner end 44*a* is the exit end 44*b* that forms part of the exhaust port 42, which is in fluid communication with an exterior of the DHD hammer. The exhaust outlet port 44 also includes exhaust port extensions 44*c* that are each in fluid communication with the exhaust port 44 and a respective inner race 40. The number of exhaust port extensions 44*c* extending from an exhaust port 44 is determined by the number of inner races 40 formed on the distal face of the drill bit 10.

The exhaust port 44 is generally positioned within the working portion 32 and below the bottom portion of the central through hole 24*a*. The exhaust port 44 is configured to be in fluid communication with the central through hole 24. However, the exhaust port 44 is configured to provide a porting conduit for the flow of exhaust air only down stream of the air inlet port 26 or the central exhaust port 46. In other words, the exhaust port 44 is not directly in fluid communication with the central through hole 24, but instead in fluid communication with the central through hole 24 via air inlet port 26 and inner race 40 or via the central exhaust port 46.

The central exhaust port 46 extends in a direction coaxial to the central through hole 24. In other words, the central exhaust port 46 exhausts air directly below and through a center of the working face 36. The central exhaust port 46 includes an enlarged discharge section 48, a hub portion 50 above the enlarged discharge section 48 and a throat portion 52. The throat portion 52 is positioned between the bottom portion of the central through hole 24*a* and the hub portion 50. The hub portion 50 is also in fluid communication with the exhaust port 44 and connected thereto about the exhaust port's inner end 44*a*.

Figure 12:
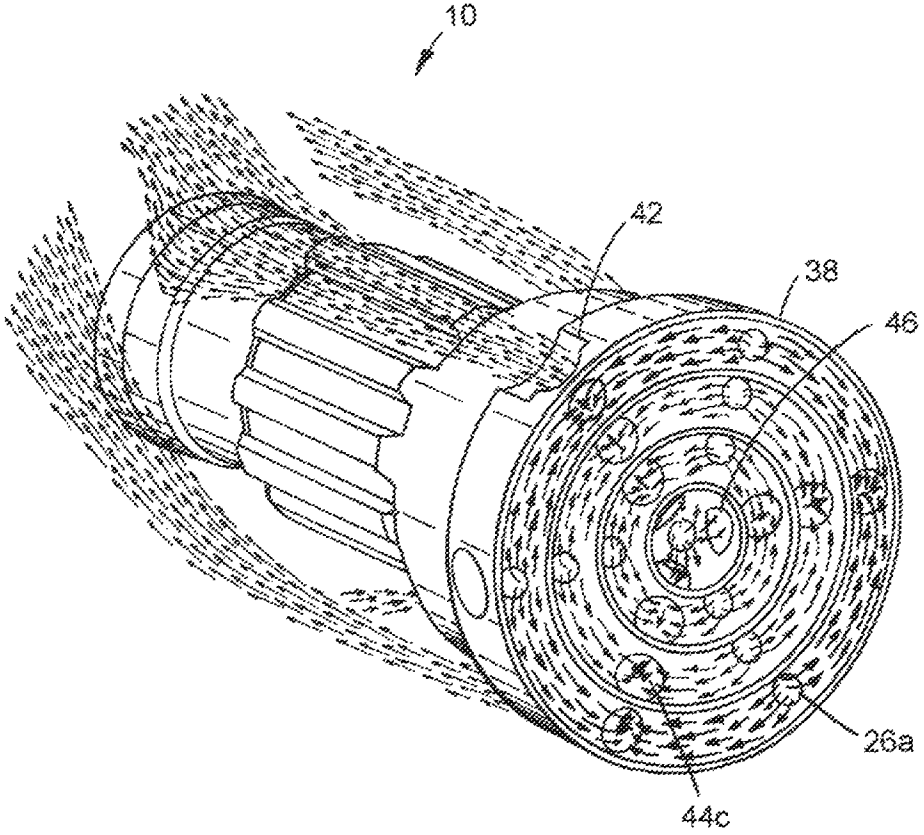
FIG. 12 is a perspective view of a drill bit in accordance with the present invention illustrating the flow of air through the drill bit's porting system.

Thus, in operation, as exhausting air is discharged through the central through hole 24 it thereafter travels to the air inlet port 26 and down port extensions 26*a* into the inner races 40. As air flows through the inner races 40 it drives drilling debris along the inner race pathways and into the exhaust port extensions 44*c*, through the exhaust outlet port 44 and finally out through exhaust ports 42 to an exterior of the DHD hammer. Additionally, exhaust air discharged through the central through hole 24 is further discharged through the central exhaust port 46 and out through the exhaust port 44. Exhaust air passing through the exhaust port 44 from the central exhaust port 46 directs the flow of air traveling within the exhaust port 44 in the radially outwardly direction or towards the exhaust port 42. FIG. 12 illustrates the flow of air through the drill bit's porting system that includes the central through hole 24, air inlet port 26, exhaust outlet port 44 and central exhaust port 46.

Figure 12A:
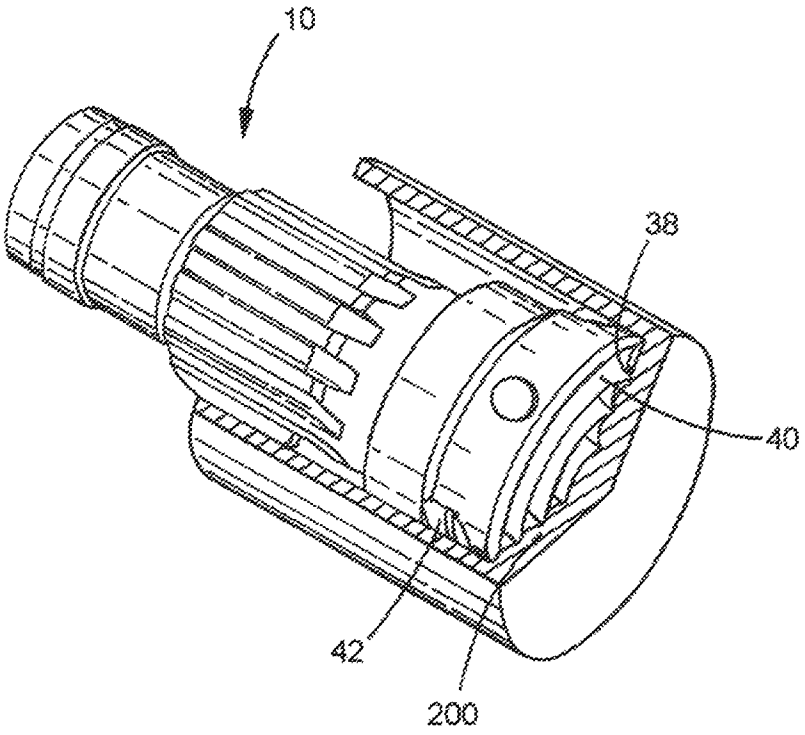
FIG. 12A is a perspective view of a drill bit in accordance with the present invention in a bore hole shown in sectional view.

Exhaust air flows through the inner races 40 of the drill bit 10 because in operation the distal face 18 of the drill bit 10 will be in facing engagement with a drilling surface 200, as shown in FIG. 12A. As a result, the drilling surface 200 in combination with the inner races 40 form a substantial enclosure that directs the flow of exhaust air within the inner race flow path.

Preferably, the drill bit 10 includes a plurality of air inlet ports 26 and a plurality of exhaust outlet ports 44. The plurality of air inlet ports 26 and exhaust outlet ports 44 are equidistantly and circumferentially spaced apart. Furthermore, the plurality of air inlet ports 26 and exhaust outlet ports 44 are positioned in an alternating fashion in the circumferential direction. More preferably, the drill bit 10 includes three air inlet ports 26 and three exhaust outlet ports 44 arranged in alternating fashion, as shown in FIG. 2.

Figure 13:
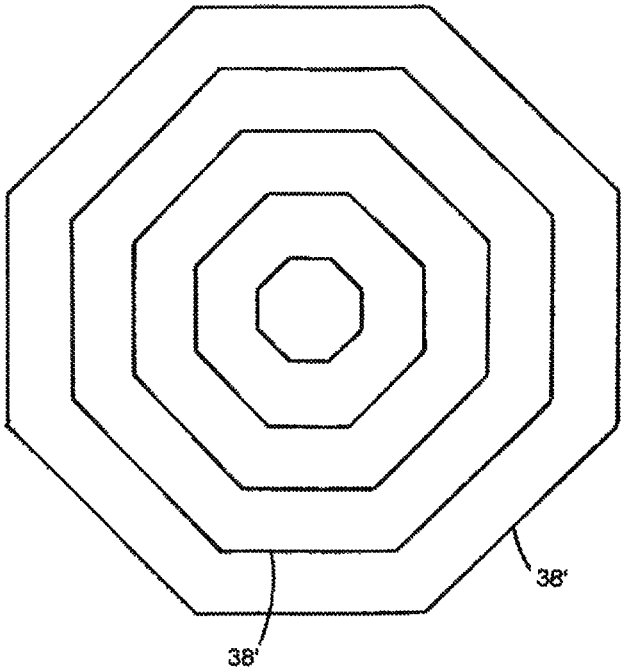
FIG. 13 is a bottom plan view sketch of an alternative configuration of cutting members applicable to the present invention.
Figure 14:
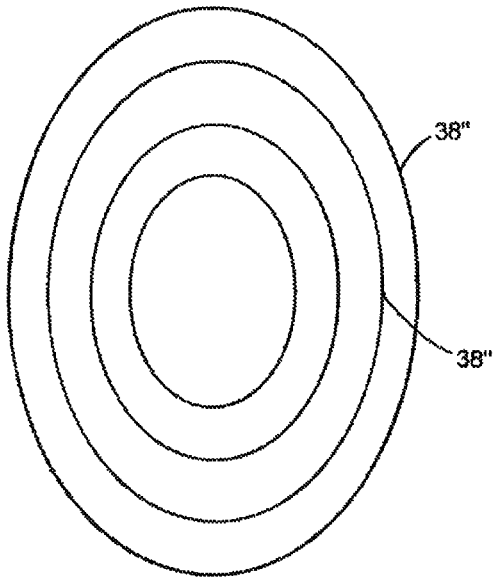
FIG. 14 is a bottom plan view sketch of a further alternative configuration of cutting members applicable to the present invention.
Figure 15:
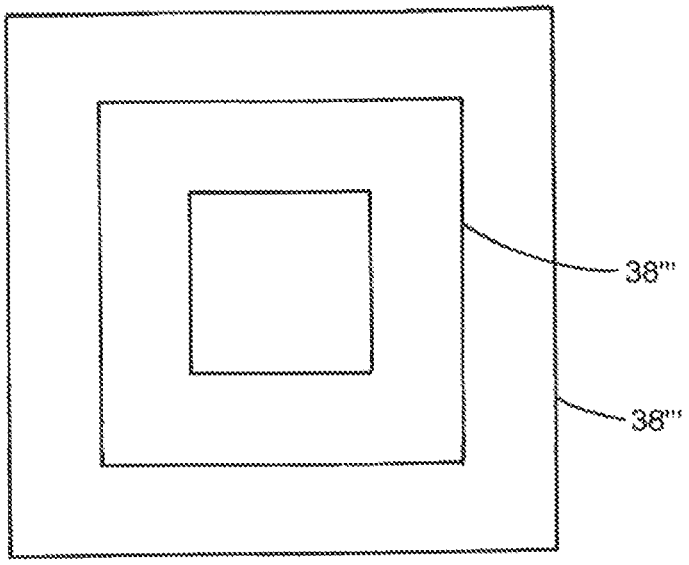
FIG. 15 is a bottom plan view sketch of yet another alternative configuration of cutting members applicable to the present invention.
Figure 16:
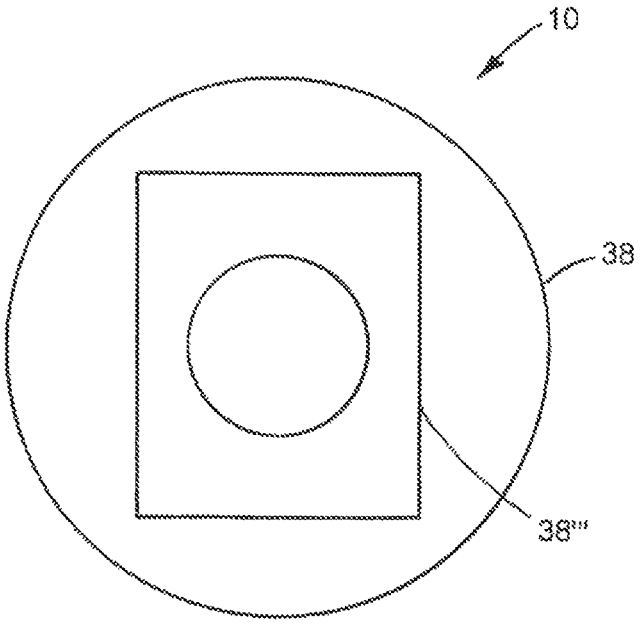
FIG. 16 is a bottom plan view sketch of another alternative configuration of cutting members applicable to the present invention.

While the foregoing embodiment has preferably been described with reference to a circular cutting ring, the cutting member 38 can alternatively be configured as any other axisymmetric configured cutting member, substantially axisymmetric configured cutting member, or continuous cutting members, such as octagonal shaped cutting members 38' (FIG. 13), oval shaped cutting members 38" (FIG. 14), square shaped cutting members 38''' (FIG. 15), combinations thereof (FIG. 16), and the like.

Figure 17:
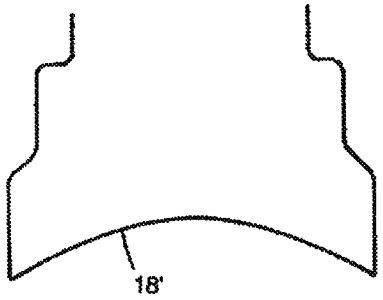
FIG. 17 is a partial side elevation view sketch of an alternative configuration of a distal face for a drill bit applicable to the present invention.
Figure 18:
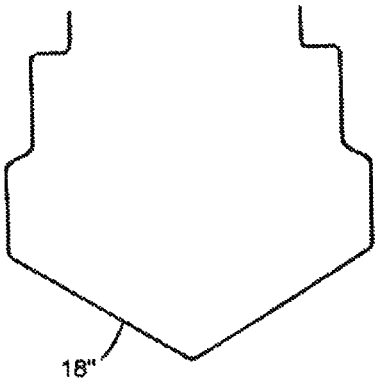
FIG. 18 is a partial side elevation view sketch of another alternative configuration of a distal face for a drill bit applicable to the present invention.
Figure 19:
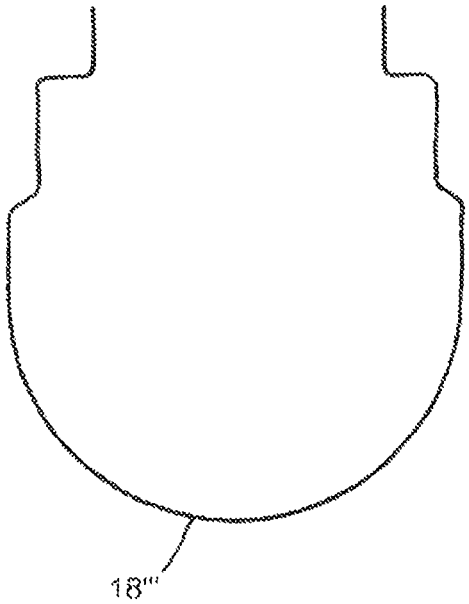
FIG. 19 is a partial side elevation view sketch of a further alternative configuration of a distal face for a drill bit applicable to the present invention.

The foregoing embodiment has also been described as preferably having a planar distal face 18. However, the distal face 18 of the drill bit can alternatively be configured to have a concave distal face 18' (FIG. 17), a conical distal face 18" (FIG. 18), a bulbous or convex distal face 18''' (FIG. 19) or any other shape applicable to the present invention.

Figure 20:
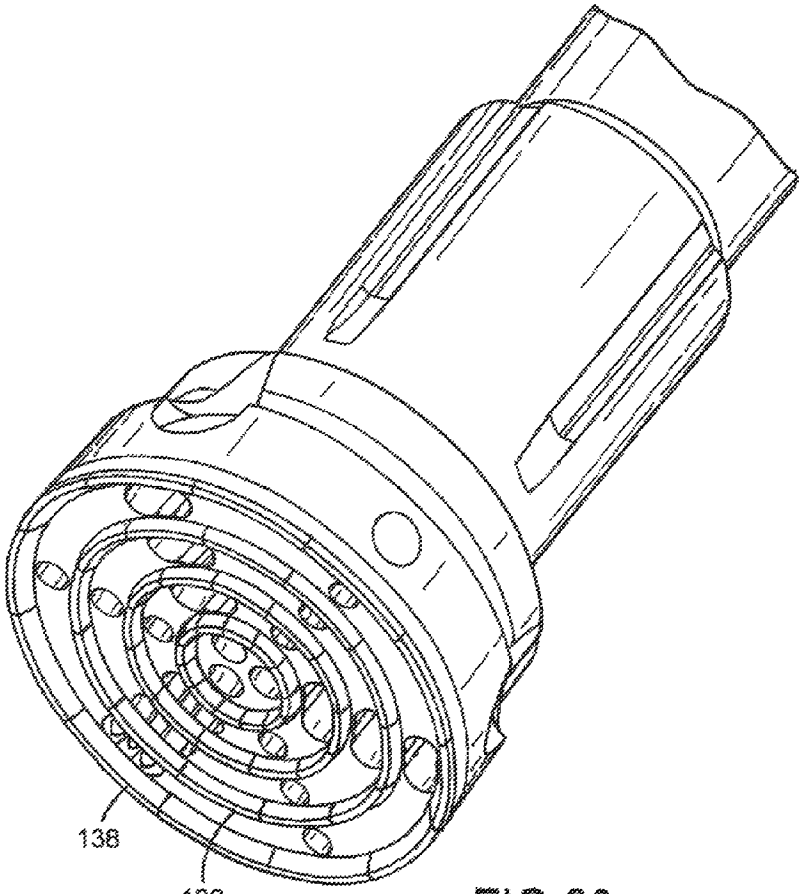
FIG. 20 is a partial perspective view of a drill bit for a down-the-hole drill hammer in accordance with another preferred embodiment of the present invention.
Figure 21:
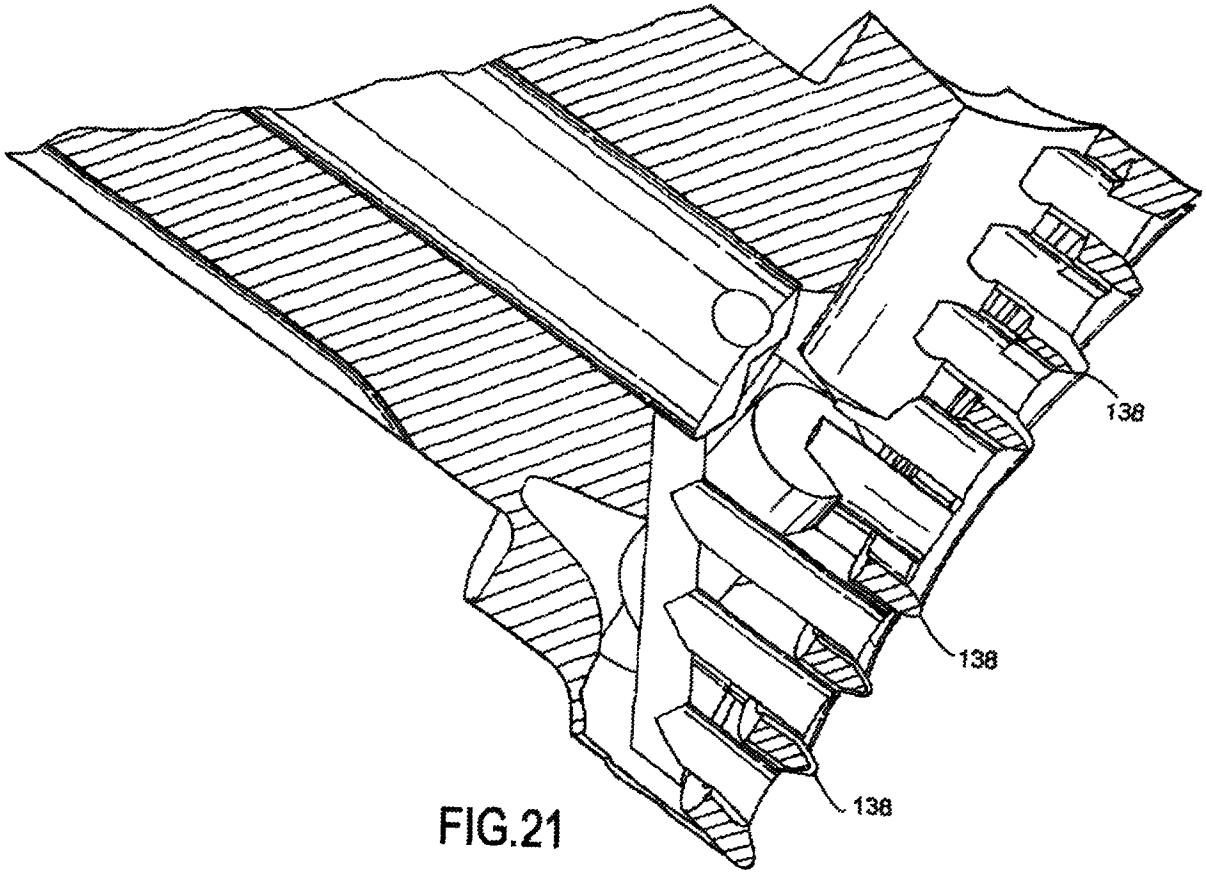
FIG. 21 is an enlarged partial perspective cross-sectional view of the drill bit of FIG. 20.

Referring to FIGS. 20 and 21, the drill bit 10 can alternatively be configured with carbide cutting members or teeth 138 that are brazed in, as best shown in FIG. 21. The carbide material applicable to the carbide cutting members 138 preferably include tungsten carbide and polycrystalline diamond coated tungsten carbide, but can alternatively be formed from other carbide materials applicable to the present invention's intended use. The carbide cutting members 138 are brazed in position about the distal face of the drill bit so as to function as described above for cutting members 38.

Figure 22:
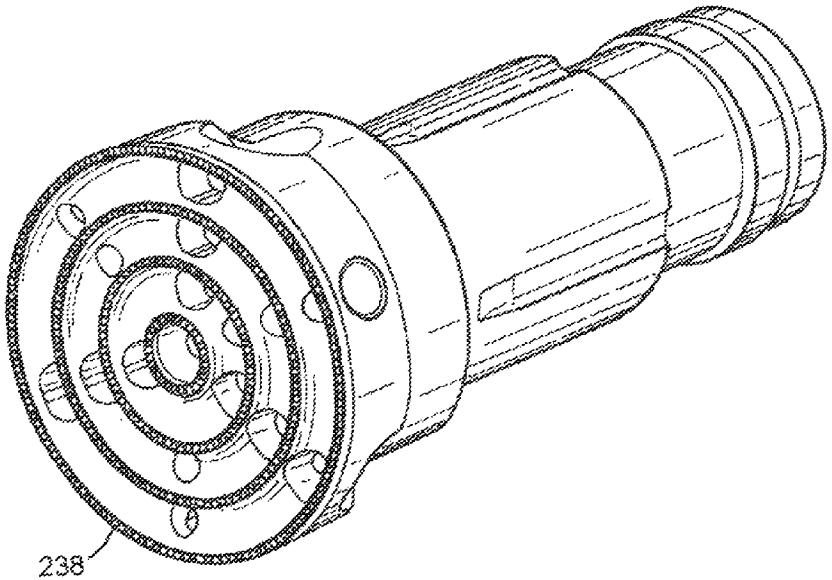
FIG. 22 is a perspective view of a drill bit for a down-the-hole drill hammer in accordance with a further preferred embodiment of the present invention.
Figure 23:
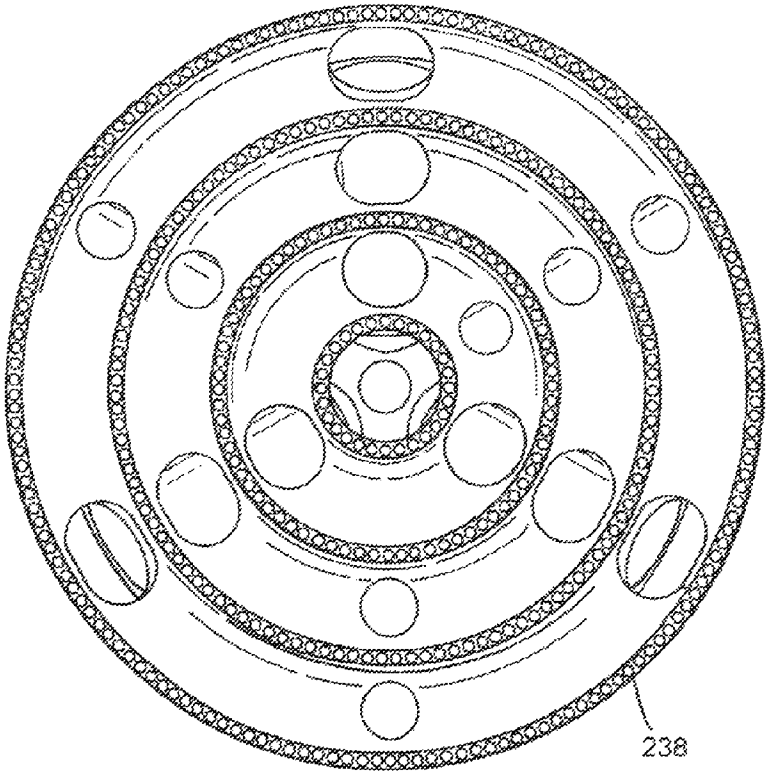
FIG. 23 is a bottom view of the drill bit of FIG. 22.
Figure 24:
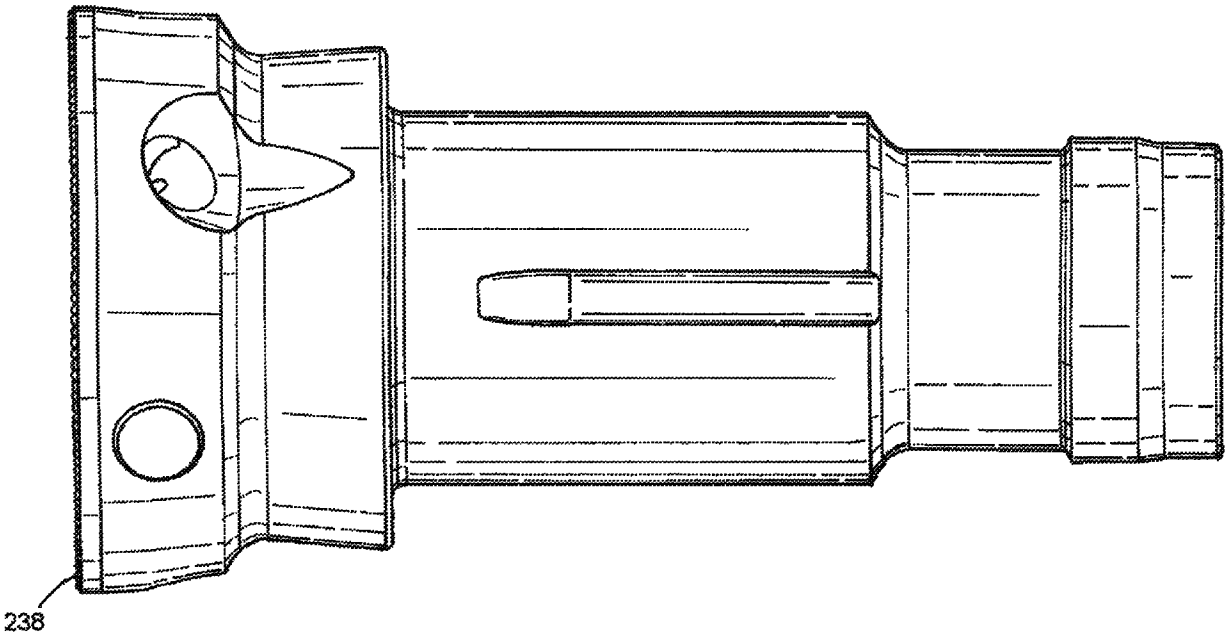
FIG. 24 is a side elevation view of the drill bit of FIG. 22.
Figure 25:
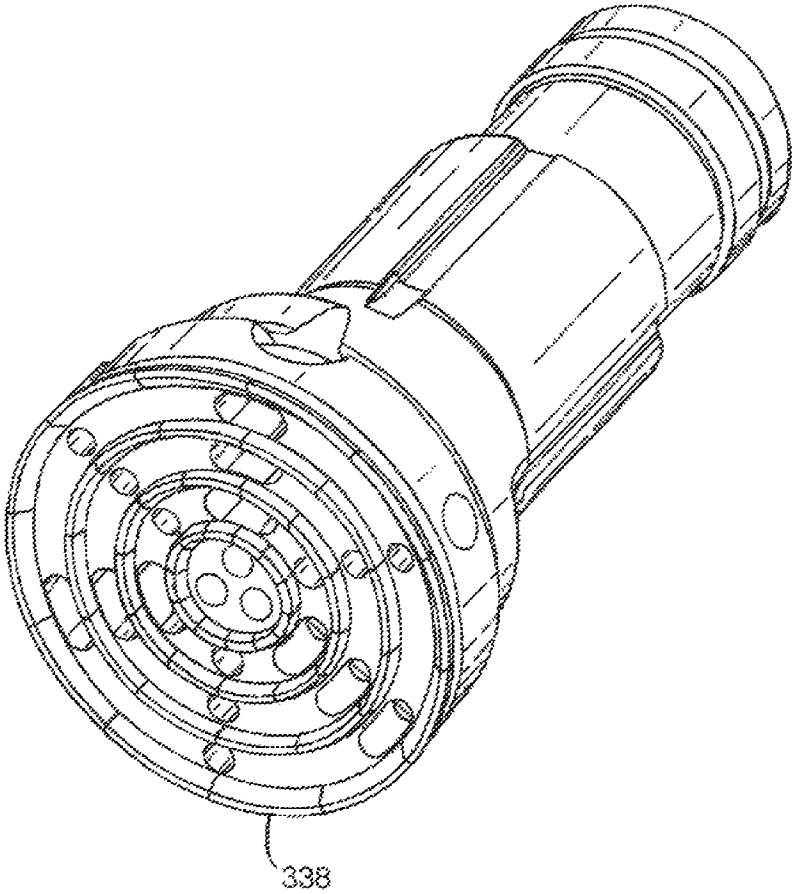
FIG. 25 is a perspective view of a drill bit for a down-the-hole drill hammer in accordance with another preferred embodiment of the present invention.
Figure 26:
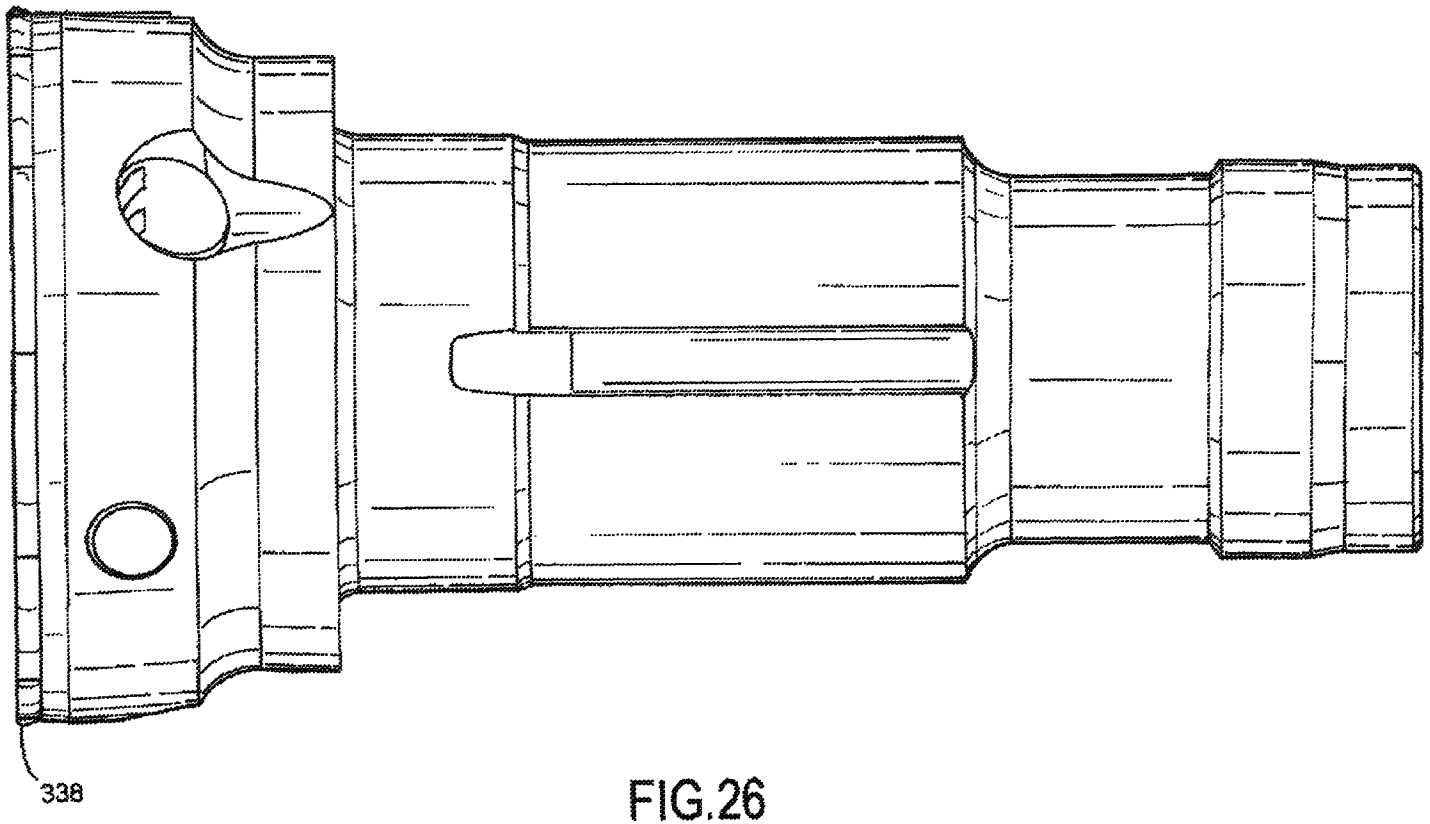
FIG. 26 is a side elevation view of the drill bit of FIG. 25.
Figure 27:
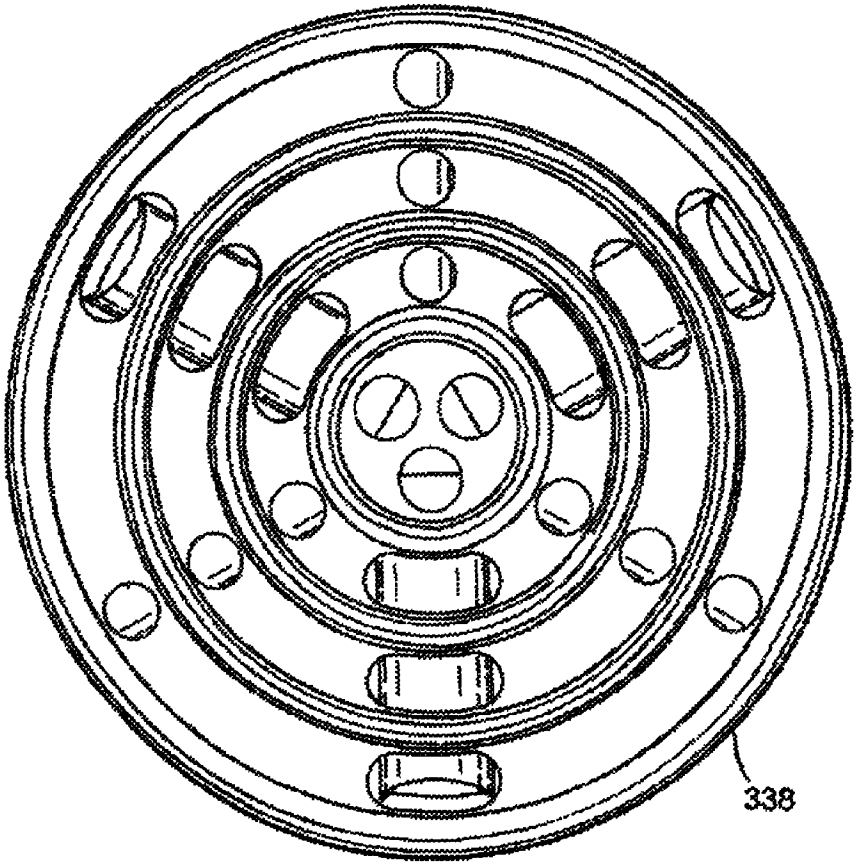
FIG. 27 is a bottom view of the drill bit of FIG. 25.
Figure 28:
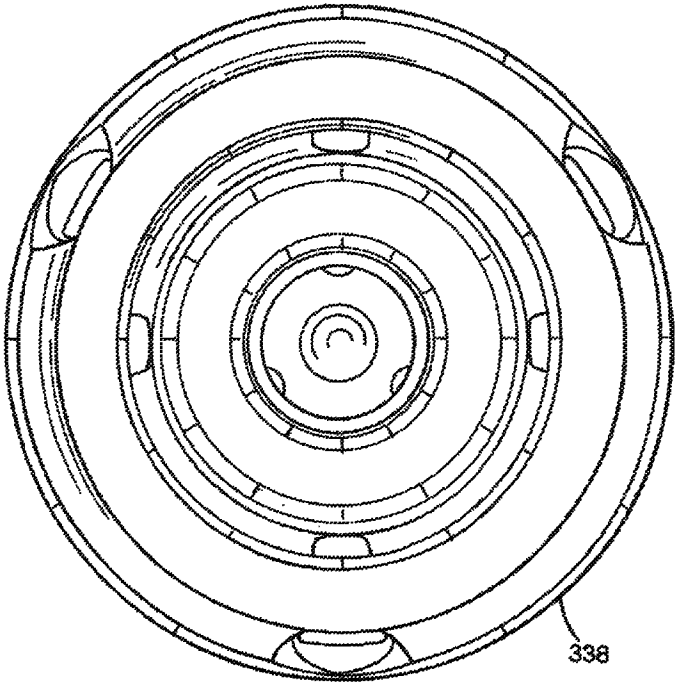
FIG. 28 is a top view of the drill bit of FIG. 25.

Referring to FIGS. 22-24, the drill bit 10 can alternatively be configured with carbide cutting members 238 formed from a plurality of small carbide balls or spheres that are brazed into the distal ends of the circular cutting rings. Referring to FIGS. 25-28, the drill bit 10 can also alternatively be configured with carbide cutting members 338 formed from a plurality of carbide arcs which collectively form a segmented carbide ring. The arc configuration of each segmented carbide ring is driven by the size of the circular cutting ring to which they are attached to. Specifically, the plurality of carbide arcs are brazed into the distal ends of the circular cutting rings of the drill bit, as best shown in FIG. 25. The carbide material applicable to the carbide cutting members 238, 338 preferably include tungsten carbide and polycrystalline diamond coated tungsten carbide, but can alternatively be formed from other carbide materials applicable to the present invention's intended use. The carbide cutting members 238, 338 are brazed in position about the distal face of the drill bit so as to function as described above for cutting members 38.

It will be appreciated by those skilled in the art that changes could be made to the embodiments described above without departing from the broad inventive concept thereof. For example, additional components can be added to the drill bit or alternative shapes of the cutting member or distal face can be used. It is to be understood, therefore, that this invention is not limited to the particular embodiment disclosed, but it is intended to cover modifications within the spirit and scope of the appended claims.

I claim:

1. A down-the-hole drill hammer comprising:

a housing;

a piston that percussively moves within the housing; and a drill bit that includes:

a shank having an impact surface for receiving percussive impact forces of the piston; and a head extending from the shank, the head including a plurality of cutting members each axisymmetric about a central longitudinal axis of the drill bit.

2. The down-the-hole drill hammer of claim 1, wherein the head further includes a concave inner race extending completely between a pair of adjacent cutting members.

3. The down-the-hole drill hammer of claim 2, wherein the head further includes a radially exhausting outlet port in fluid communication with the inner race.

4. The down-the-hole drill hammer of claim 2, wherein the drill bit further includes a central through hole extending axially through the drill bit, and an air inlet port extending radially from the central through hole and in fluid communication with the central through hole and the inner race.

5. The down-the-hole drill hammer of claim 1, wherein each cutting member continuously circumscribes the central longitudinal axis.

6. The down-the-hole drill hammer of claim 1, wherein the plurality of cutting members comprise carbide.

7. The down-the-hole drill hammer of claim 1, wherein the plurality of cutting members are configured as dual inclined planes.

8. The down-the-hole drill hammer of claim 1, wherein the drill bit further includes a central exhaust port extending through the drill bit and an exhaust outlet port extending substantially perpendicular to and in communication with the central exhaust port.

9. The down-the-hole drill hammer of claim 1, wherein the plurality of cutting members include a carbide cutting member.

10. The down-the-hole drill hammer of claim 9, wherein the carbide cutting member is a circular ring, a sphere, or a segmented circular ring.

11. The down-the-hole drill hammer of claim 9, wherein the carbide cutting member is a brazed in cutting member.

12. The down-the-hole drill hammer of claim 1, wherein the plurality of cutting members include at least three cutting members.

13. The down-the-hole drill hammer of claim 1, wherein the plurality of cutting members are circular cutting members, octagonal shaped cutting members, oval shaped cutting members, or square shaped cutting members.

14. The down-the-hole drill hammer of claim 1, wherein the head further includes a distal face for engaging earthen terrain.

15. The down-the-hole drill hammer of claim 14, wherein the plurality of cutting members extend from the distal face.

16. The down-the-hole drill hammer of claim 1, wherein the drill bit further includes a central through hole extending axially through the drill bit and an air inlet port extending radially from and in communication with the central through hole.

* * * * *